US007407007B2

(12) United States Patent
Tibbles

(10) Patent No.: US 7,407,007 B2
(45) Date of Patent: Aug. 5, 2008

(54) SYSTEM AND METHOD FOR ISOLATING FLOW IN A SHUNT TUBE

(75) Inventor: Raymond J. Tibbles, Kuala Lumpur (MY)

(73) Assignee: Schlumberger Technology Corporation, Sugar Land, TX (US)

( * ) Notice: Subject to any disclaimer, the term of this patent is extended or adjusted under 35 U.S.C. 154(b) by 259 days.

(21) Appl. No.: 11/162,047

(22) Filed: Aug. 26, 2005

(65) Prior Publication Data

US 2007/0044962 A1 Mar. 1, 2007

(51) Int. Cl.
*E21B 43/04* (2006.01)

(52) U.S. Cl. ..... 166/278; 166/51

(58) Field of Classification Search ..... 166/278, 166/51

See application file for complete search history.

(56) References Cited

U.S. PATENT DOCUMENTS

| | | | | |
|---|---|---|---|---|
| 2,945,451 | A | 7/1960 | Griswold | |
| 3,385,367 | A | 5/1968 | Kollsman | |
| 4,862,967 | A | 9/1989 | Harris | |
| 5,065,768 | A * | 11/1991 | Coleman et al. | 600/573 |
| 6,298,916 | B1 * | 10/2001 | Tibbles et al. | 166/278 |
| 6,634,431 | B2 | 10/2003 | Cook et al. | |
| 6,719,064 | B2 | 4/2004 | Price-Smith et al. | |
| 6,722,437 | B2 | 4/2004 | Vercaemer et al. | |
| 6,820,690 | B2 | 11/2004 | Vercaemer et al. | |
| 6,834,725 | B2 | 12/2004 | Whanger et al. | |
| 6,840,325 | B2 | 1/2005 | Stephenson | |
| 6,848,505 | B2 | 2/2005 | Richard et al. | |
| 6,854,522 | B2 | 2/2005 | Brezinski et al. | |
| 2002/0189821 | A1 * | 12/2002 | Watson et al. | 166/387 |
| 2003/0146003 | A1 | 8/2003 | Duggan et al. | |
| 2004/0118572 | A1 | 6/2004 | Whanger et al. | |
| 2004/0123983 | A1 | 7/2004 | Cook et al. | |
| 2005/0072576 | A1 | 4/2005 | Henriksen et al. | |
| 2005/0072579 | A1 | 4/2005 | Gambier | |

FOREIGN PATENT DOCUMENTS

| | | |
|---|---|---|
| GB | 0247593 | 1/1927 |
| GB | 2404397 | 2/2005 |
| WO | WO 2002/20941 | 3/2002 |
| WO | WO 2002/059452 | 8/2002 |
| WO | WO 2003/008756 | 1/2003 |
| WO | WO 2003/056125 | 7/2003 |
| WO | WO 2004/005665 | 1/2004 |
| WO | WO 2004/005669 | 1/2004 |
| WO | WO 2004/018836 | 3/2004 |
| WO | WO 2004/022911 | 3/2004 |
| WO | WO 2004/027209 | 4/2004 |
| WO | WO 2004/057715 | 7/2004 |
| WO | WO 2004/101952 | 11/2004 |
| WO | WO 2005/012686 | 2/2005 |

* cited by examiner

*Primary Examiner*—Jennifer H Gay
*Assistant Examiner*—Sean D Andrish
(74) *Attorney, Agent, or Firm*—Robert Van Someren; Jeremy P. Welch; Bryan P. Galloway

(57) ABSTRACT

A technique is provided to selectively control flow along shunt tubes, such as those used in gravel pack operations. The technique utilizes a swellable material valve that comprises a swellable material deployed along the shunt tube flow path. When flow through a specific shunt tube is no longer desired, the swellable material valve can be exposed to a substance that induces swelling of the swellable material. The expanded or swollen material blocks further flow along the shunt tube.

22 Claims, 3 Drawing Sheets

SYSTEM AND METHOD FOR ISOLATING FLOW IN A SHUNT TUBE

BACKGROUND

Various subterranean formations contain hydrocarbons in fluid form which can be produced to a surface location for collection. Generally, a wellbore is drilled, and a production completion is moved downhole to facilitate production of desired fluids from the surrounding formation. Many of the formation fluids, however, contain particulates, e.g. sand, that can wear or otherwise detrimentally impact both downhole and surface components.

Gravel packing techniques, including frac packing procedures, are often used to control sand. In typical gravel packing operations, a slurry of gravel carried in a transport fluid is pumped into a well annulus between a sand screen and the surrounding casing or open wellbore. The deposited gravel is dehydrated, and the gravel facilitates blocking of sand or other particulates that would otherwise flow with formation fluids into the production equipment.

In some gravel packing operations, difficulty arises in obtaining uniform distribution of gravel throughout the desired gravel pack region. For example, a poor distribution of gravel can result from premature loss of transport fluid, which causes the creation of bridges that can prevent or reduce further distribution of gravel past the bridge. Also, certain manmade isolation devices, such as packers, can present barriers to distribution of the gravel slurry. Shunt tubes have been used to bypass bridges and/or manmade isolation devices to ensure complete gravel packing. However, upon completion of the gravel packing procedure, the shunt tubes can leave undesirable flow paths, e.g. an undesirable flow path past a packer. Mechanical valves have been used to close off shunt tubes, but such valves must be cycled and are limited to shunt tubes of small size.

SUMMARY

In general, the present invention provides a system and method for selectively blocking flow through a shunt tube, such as a shunt tube used with a gravel pack completion. An isolation device, in the form of a swellable material valve, is used in the flow path of fluid passing through the shunt tube. At a desired time, such as upon completion of the gravel pack procedure or at a time during production, the swellable material is exposed to a substance that induces swelling, thus blocking further flow through the shunt tube.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to controlling fluid flow, and particularly to controlling the unwanted flow of fluid through one or more shunt tubes used in downhole applications. For example, shunt tubes are used in many gravel packing operations, and upon completion of such an operation, it may be desirable to restrict further flow through the shunt tubes. In one embodiment, a completion designed to accommodate a gravel packing procedure is moved downhole. The completion incorporates shunt tubes that can be used to facilitate movement of gravel slurry past manmade devices, such as packers, and/or to reduce the detrimental effects of bridges that can form during the gravel packing operation. One or more shunt tubes can be positioned to extend through one or more completion zones within the wellbore. This enables formation of better gravel packs at the one or more wellbore zones.

The present system and methodology incorporate dependable isolation devices that are used selectively to block flow through the one or more shunt tubes when such flow is no longer desired. For example, in a gravel pack operation, it may be desirable to shut off further flow through the shunt tubes once a gravel pack has been formed. The isolation device utilizes a swellable material that can be caused to expand at the desired time to shut off fluid flow along the shunt tube flow path, as described more fully below.

Figure 1:
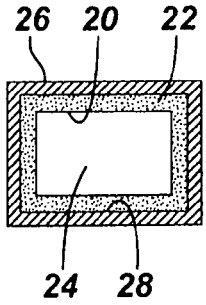
FIG. 1 is a schematic cross sectional view of swellable material deployed along a shunt tube flow path in an unexpanded state, according to an embodiment of the present invention.

Referring generally to FIG. 1, a swellable material valve 20 is illustrated, according to an embodiment of the present invention. Swellable material valve 20 comprises a swellable material 22 that swells, i.e. expands, upon contact with a specific substance, such as water or a hydrocarbon fluid. The swellable material valve 20 is deployed in a shunt tube flow path 24 along which, for example, a gravel slurry may be flowed when directing the gravel slurry to a gravel pack region in a wellbore.

In the embodiment illustrated, swellable material valve 20 is deployed directly within a shunt tube 26. It should be noted, however, the shunt tube flow path 24 may be routed through completion components in addition to shunt tube 26. For example, shunt tube 26 may be coupled to an existing passage of a packer such that the shunt tube flow path 24 is routed through both the shunt tube and the additional completion component. Regardless, placement of the swellable material valve 20 at a location along the shunt tube flow path enables flow along that path to be blocked.

In the embodiment of FIG. 1, swellable material 22 of swellable material valve 20 is deployed along an interior surface 28 of shunt tube 26. Thus, swellable material 22 creates a lining that defines the flow path for gravel laden slurry. Accordingly, during gravel packing of a specific wellbore region, the gravel slurry freely flows through swellable material valve 20 along flow path 24. When the gravel packing procedure is completed or at another desired time, swellable material valve 20 can be exposed to an appropriate substance to induce swelling of swellable material 22.

Figure 2:
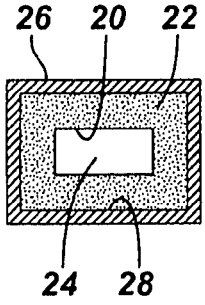
FIG. 2 is a schematic cross sectional view similar to that in FIG. 1, but showing the swellable material in a partially swollen state that limits flow along the shunt tube flow path, according to an embodiment of the present invention.
Figure 3:
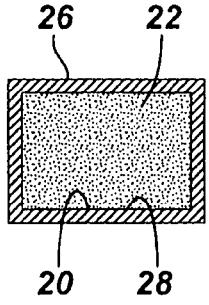
FIG. 3 is a schematic cross sectional view similar to that in FIG. 1, but showing the swellable material in an expanded or swollen state that blocks flow along the shunt tube flow path, according to an embodiment of the present invention.

As illustrated in FIG. 2, the swell inducing substance, e.g. water or a hydrocarbon fluid, causes swellable material 22 to expand such that swellable material valve 20 restricts flow along flow path 24. By exposing swellable material 22 to the swell inducing substance in sufficient amount and time, the material continues to swell until swellable material valve 20 closes off further flow along flow path 24, as illustrated in FIG. 3. In the particular embodiment illustrated, the swellable material 22 is disposed directly within shunt tube 26 and any further flow through the shunt tube is blocked.

Depending on the specific type of well, wellbore environment, formation, and completion equipment, a variety of swellable material valves 20 can be utilized in a variety of positions within the shunt tube or along the shunt tube flow path. Additionally, many applications may utilize a plurality of shunt tubes 26 with one or more swellable material valves 20 located in each shunt tube 26 or along the plurality of shunt tube flow paths 24. The swellable material 22 selected for valves 20 of a given system also may vary. For example, the swellable material 22 may be selected to expand in the presence of one specific substance, such as water or a hydrocarbon fluid. In other embodiments, the swellable material 22 may be formed of composite materials or from materials that swell when exposed to other or multiple swell inducing substances. In some embodiments, the swellable material is selected based on naturally occurring fluids found in the wellbore and to which the swellable material 22 can be exposed at controlled times. In other embodiments, the swellable material 22 is selected such that it expands when exposed to a specific substance or substances that are pumped along the shunt tube flow path and into contact with the swellable material valve 20 at specific times during a given procedure.

Figure 4:
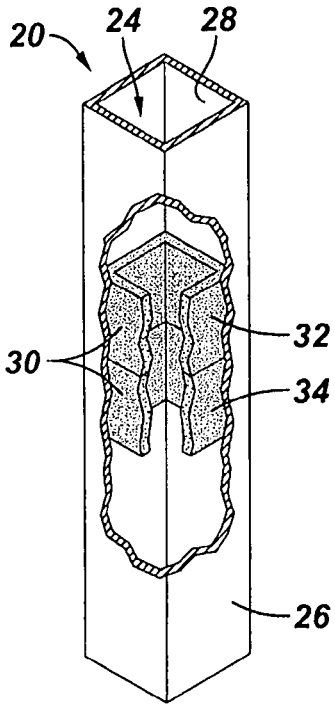
FIG. 4 is an orthogonal view of a swellable material valve having a composite swellable material, according to an embodiment of the present invention.

One example is illustrated in FIG. 4. In this embodiment, swellable material valve 20 and swellable material 22 is formed of a composite material 30. By way of example, composite material 30 may comprise a material component 32 that swells when exposed to water and another material component 34 that swells when exposed to a hydrocarbon fluid, such as oil. Again, the composite material 30 may be positioned along the shunt tube flow path 24.

In the specific example illustrated, the composite material 30 is formed by contiguous material component elements configured as a lining that surrounds flow path 24. The lining may be deployed along the interior surface 28 of a shunt tube 26.

Figure 5:
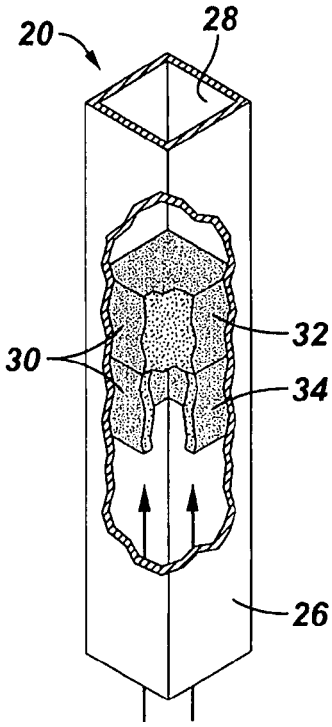
FIG. 5 is a view similar to that of FIG. 4, but showing a portion of the composite swellable material in an expanded state, according to an embodiment of the present invention.
Figure 6:
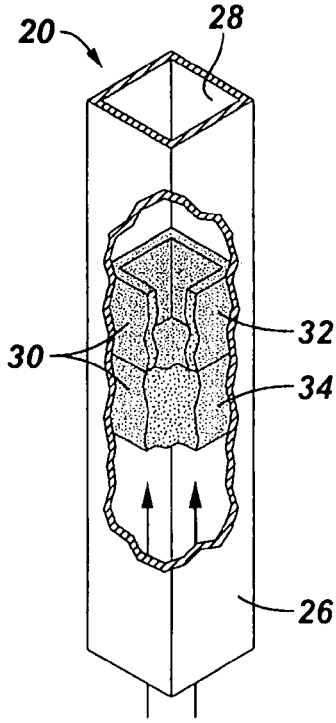
FIG. 6 is a view similar to that of FIG. 4, but showing a portion of the composite swellable material in an expanded state, according to an embodiment of the present invention.

Use of the composite material 30 enables closing of swellable material valve 20 when contacted by water, as illustrated in FIG. 5. For example, water directed downwardly along the shunt tube flow path or water naturally occurring in the well can be flowed to swellable material valve 20 and specifically to material component 32, thereby inducing closing of the valve. Alternatively or in addition to the exposure to water, swellable material valve 20 can be exposed to a specific hydrocarbon, such as oil, as illustrated in FIG. 6. The exposure to oil induces the swelling of material component 34 and the closure of valve 20. Accordingly, flow through the shunt tube 26 can be blocked by inducing the closure of valve 20 with alternate substances or a combination of substances.

A variety of materials can be used to create the swellable material valve 20, regardless of whether individual materials or composite materials are selected. In the embodiments illustrated, for example, a swellable elastomer that swells in the presence of water, oil or other specific substances is used. The swellable elastomer can be formed in a variety of shapes and configurations depending, at least in part, on the size and shape of the flow passage to be selectively blocked. Examples of swellable materials are nitrile mixed with a salt or hydrogel, EPDM (ethylene propylene diene monomer), or other swelling elastomers available to the petroleum production industry. In other embodiments, additional swellable materials such as super absorbent polyacrylamide or modified crosslinked poly(meth)acrylate can be used to form swellable material valve 20.

Figure 7:
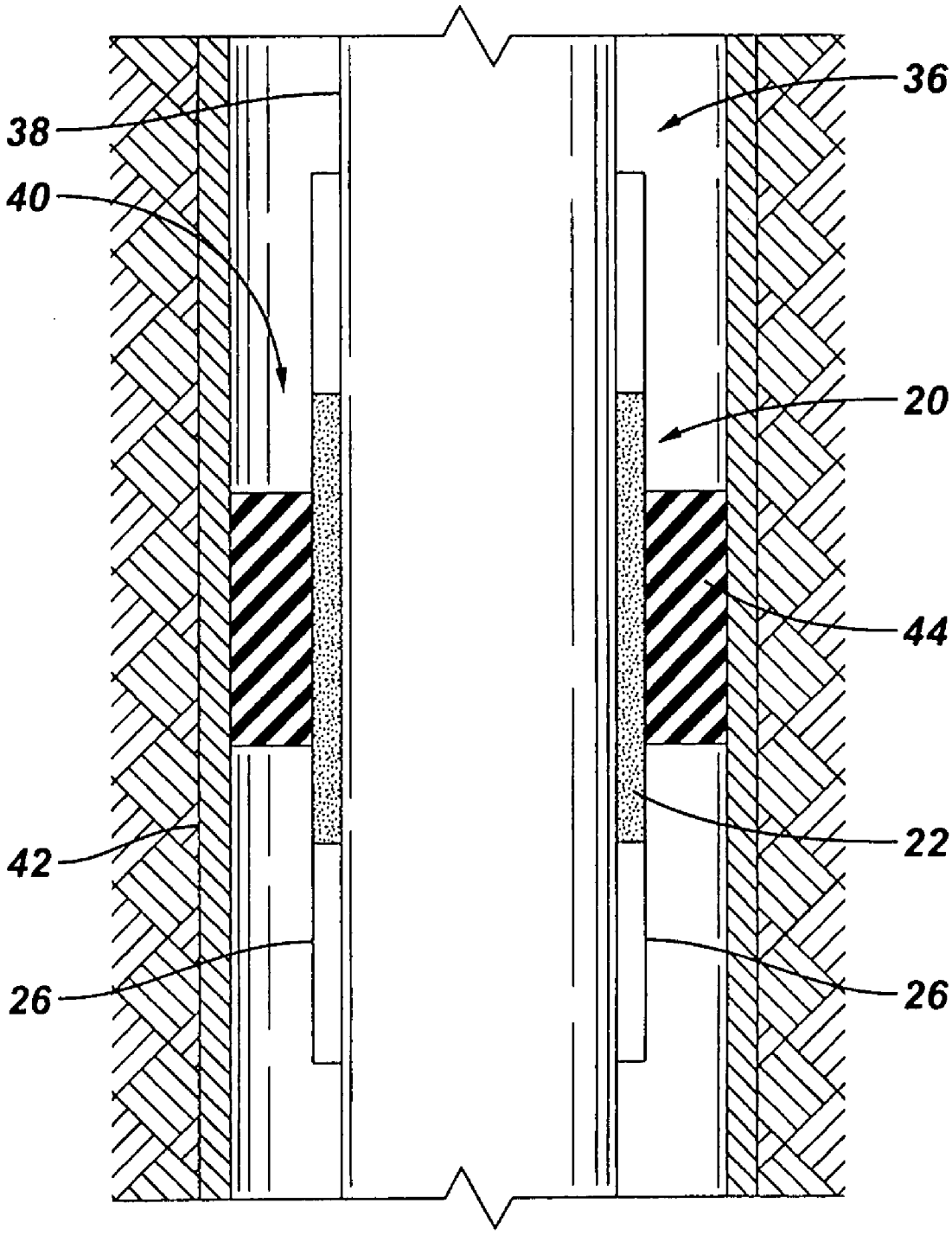
FIG. 7 is front view of a portion of a completion located in a wellbore, the completion incorporating shunt tubes having swellable material valves, according to another embodiment of the present invention.

Referring to FIG. 7, and embodiment of a basic completion 36 that can be utilized in a wellbore to create the gravel pack is illustrated. In this embodiment, completion 36 comprises a main conduit 38, such as a production tubing, deployed in a wellbore 40 that may be lined with a casing 42. The conduit 38 extends through a packer 44 that may be used to isolate a region of wellbore 40, e.g. a region to be gravel packed. Additionally, a plurality of shunt tubes 26 are deployed along completion 36 and through packer 44 to deliver gravel slurry to the gravel pack region. As illustrated, a swellable material valve 20 is deployed in each shunt tube 26 to selectively block flow along the shunt tube flow path. In this embodiment, swellable material valves 20 are located at packer 44 to enable the blockage of any further flow through packer 44 once the gravel packing operation has been completed and no further gravel slurry is required. At this point, a swell inducing substance, such as water or oil, can be moved or allowed to move into contact with swellable material valves 20 to induce swelling of swellable material 22 and the closure of shunt tubes 26.

Figure 8:
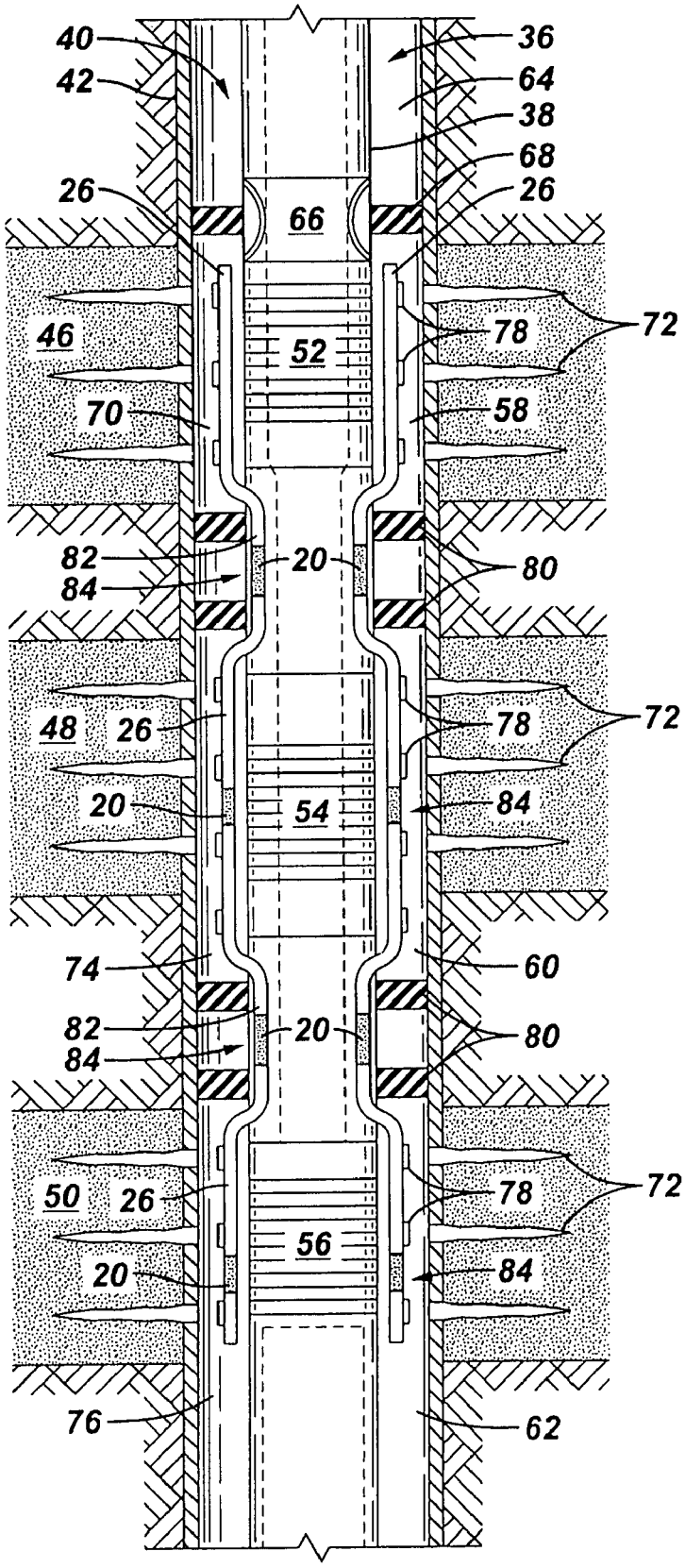
FIG. 8 illustrates another embodiment of completion equipment incorporating swellable material valves to selectively blocking flow along a shunt tube flow path, according to an embodiment of the present invention.

A more detailed example of the use of shunt tubes with wellbore completion equipment is illustrated in FIG. 8. It should be noted, however, that this is just one example and that the swellable material valves can be utilized in a variety of completion configurations and gravel packing procedures.

In the embodiment of FIG. 8, wellbore 40 is again lined with casing 42. Completion 36 is deployed on tubing 38, such as production tubing, and extends across a plurality of wellbore zones, such as zones 46, 48 and 50. However, the number of zones can vary from a single zone to many additional zones depending on the specific formation and application. The completion 36 further comprises a plurality of particulate control devices 52, 54 and 56, such as sand screens, which are positioned generally within the respective zones 46, 48 and 50.

In addition to the sand screens, a plurality of gravel packs 58, 60 and 62 are formed in the annular regions surrounding the sand screens within each of the wellbore zones 46, 48 and 50, respectively. The gravel packs are formed by pumping a gravel slurry down an upper annular region 64 between tubing 38 and casing 42. A crossover device 66 is used to enable the flow of gravel slurry past an upper packer assembly 68 and into a first annular wellbore region 70 corresponding to zone 46. In other words, formation fluid from zone 46 can flow through perforations 72 and into annular wellbore region 70 within casing 42.

One or more shunt tubes 26 are deployed along completion 36 in annular wellbore region 70. The shunt tubes 26 can be designed to extend downwardly through an annular wellbore region 74 corresponding to zone 48 and through an annular wellbore region 76 corresponding to zone 50. In this embodiment, the shunt tubes 26 comprise ports 78 through which the gravel slurry can flow for gravel packing annular wellbore regions 70, 74 and 76. Additionally, packer assemblies 80 can be used to isolate the three zones 46, 48 and 50. The packer assemblies 80 may be designed to accommodate the extension of shunt tubes 26 therethrough, or the packer assemblies may comprise internal side conduits 82 to which the shunt tubes 26 are coupled. With either embodiment, the shunt tube flow path 24 continues along completion 36 from one wellbore zone to another.

It should be noted that flow control devices (not shown) in addition to swellable material valves 20 can be placed in internal side conduits 82 to provide further control over the flow of gravel slurry into each annular wellbore region during the gravel packing procedure. Additionally, the swellable material valves 20 can be deployed at one or more locations 84 along the shunt tube flow path. For example, valves 20 maybe used at locations 84 directly within shunt tubes 26 or along shunt tube flow path 24 within other components. For example, the swellable material valves 20 can be placed in side conduits 82 of packers 80 to selectively block further flow through the corresponding shunt tubes upon completion of the gravel packing procedure.

The embodiments illustrated and described with reference to FIGS. 7 and 8 are to further the understanding of the reader regarding the use of swellable material valves to block flow along one or more shunt tube flow paths within a wellbore environment. However, these embodiments are examples. The actual number of zones isolated, the type of equipment used in a completion, the arrangement of completion equipment, the shape/size and formulation of the swellable material valves, the procedures for inducing expansion of the swellable material, and the period for inducing expansion during a given procedure, for example, can vary from one application to another.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for use in a wellbore, comprising:

a gravel pack completion having:

a shunt tube for conducting a material along a shunt tube flow path; and a swellable material valve deployed in the shunt tube flow path to shut off flow along the shunt tube flow path after a gravel pack procedure.

2. The system as recited in claim 1, wherein the swellable material valve comprises a swellable material that swells when exposed to water.

3. The system as recited in claim 1, wherein the swellable material valve comprises a swellable material that swells when exposed to a hydrocarbon fluid.

4. The system as recited in claim 1, wherein the swellable material valve comprises a composite of swellable materials including at least one material that swells when exposed to water and at least one material that swells when exposed to a hydrocarbon fluid.

5. The system as recited in claim 1, wherein the gravel pack completion further comprises a packer, and the swellable material valve is located at the packer.

6. The system as recited in claim 1, wherein the swellable material valve is deployed within the shunt tube.

7. The system as recited in claim 1, wherein the swellable material valve comprises a plurality of swellable material valves deployed at unique locations along the shunt tube flow path.

8. The system as recited in claim 1, wherein the swellable material valve comprises a swellable elastomer.

9. A method of controlling a gravel packing procedure, comprising:

flowing a gravel slurry to a gravel pack location by routing the gravel slurry through a shunt tube; and subsequently blocking flow through the shunt tube with a swellable material deployed in a flow path.

10. The method as recited in claim 9, wherein subsequently blocking flow comprises selecting the swellable material such that it swells when exposed to water.

11. The method as recited in claim 9, wherein subsequently blocking flow comprises selecting the swellable material such that it swells when exposed a hydrocarbon fluid.

12. The method as recited in claim 9, wherein subsequently blocking flow comprises selecting the swellable material such that it comprises a composite material that swells when exposed to water and to a hydrocarbon fluid.

13. The method as recited in claim 9, wherein subsequently blocking flow comprises blocking flow at a plurality of locations.

14. The method as recited in claim 9, further comprising placing the swellable material directly within the shunt tube.

15. The method as recited in claim 9, wherein subsequently blocking flow comprises selecting a swellable elastomeric material to block flow.

16. A method, comprising:

locating a shunt tube within a wellbore;

lining an interior of the shunt tube with a swellable material to define a flow path for a gravel laden slurry; and blocking flow through the shunt tube with the swellable material that swells upon exposure to a specific fluid.

17. The method as recited in claim 16, wherein locating comprises moving the shunt tube downhole with a gravel pack completion.

18. The method as recited in claim 16, wherein blocking comprises stopping flow of the gravel laden slurry by exposing the swellable material to a fluid that causes it to swell.

19. The method as recited in claim 16, wherein blocking comprises stopping flow of the gravel laden slurry by exposing the swellable material to water and thereby causing it to swell.

20. The method as recited in claim 16, wherein blocking comprises stopping flow of the gravel laden slurry by exposing the swellable material to a hydrocarbon fluid and thereby causing it to swell.

21. The method as recited in claim 16, wherein locating comprises locating a plurality of shunt tubes in the wellbore; and blocking flow comprises stopping flow through the plurality of shunt tubes at a plurality of locations.

22. A system, comprising:

a shunt tube having a swellable material valve located in the shunt tube to selectively block flow through the shunt tube; and a gravel pack completion for use in wellbore, wherein the shunt tube forms part of the gravel pack completion.

* * * * *